US010301879B2

(12) United States Patent
Hay

(10) Patent No.: US 10,301,879 B2
(45) Date of Patent: May 28, 2019

(54) VARIABLE VALVE AXIAL OSCILLATION TOOL

(71) Applicant: Halliburton Energy Services, Inc., Houston, TX (US)

(72) Inventor: Charles Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 190 days.

(21) Appl. No.: 15/038,080

(22) PCT Filed: Jan. 21, 2014

(86) PCT No.: PCT/US2014/012327

§ 371 (c)(1),
(2) Date: May 20, 2016

(87) PCT Pub. No.: WO2015/112119

PCT Pub. Date: Jul. 30, 2015

(65) Prior Publication Data

US 2016/0305188 A1 Oct. 20, 2016

(51) Int. Cl.

| | |
|---|---|
| ***E21B 7/24*** | (2006.01) |
| ***E21B 47/18*** | (2012.01) |
| ***E21B 21/10*** | (2006.01) |
| ***E21B 34/06*** | (2006.01) |
| ***E21B 44/00*** | (2006.01) |
| ***E21B 47/10*** | (2012.01) |
| ***E21B 28/00*** | (2006.01) |
| *E21B 34/00* | (2006.01) |

(52) U.S. Cl.

CPC ..... *E21B 7/24* (2013.01); *E21B 21/10* (2013.01); *E21B 28/00* (2013.01); *E21B 34/066* (2013.01); *E21B 44/00* (2013.01); *E21B 47/10* (2013.01); *E21B 47/18* (2013.01); *E21B 2034/002* (2013.01)

(58) Field of Classification Search

CPC ..... E21B 7/24
USPC ..... 175/24
See application file for complete search history.

(56) References Cited

U.S. PATENT DOCUMENTS

| | | | | |
|---|---|---|---|---|
| 3,602,317 | A | 8/1971 | Scroggins | |
| 3,845,837 | A | 5/1974 | McEvers, Jr. et al. | |
| 4,003,017 | A * | 1/1977 | Bailey | E21B 47/02 175/45 |
| 4,615,401 | A | 10/1986 | Garrett | |
| 5,305,837 | A | 5/1994 | Johns et al. | |
| 5,316,094 | A | 5/1994 | Pringle | |

(Continued)

FOREIGN PATENT DOCUMENTS

| | | |
|---|---|---|
| CN | 1021516 | 7/1993 |
| WO | WO2008007066 | 1/2008 |

OTHER PUBLICATIONS

International Search Report and Written Opinion issued by the US International Searching Authority regarding International application No. PCT/US14/12327, dated May 9, 2014, 17 pages.

(Continued)

*Primary Examiner* — Taras P Bemko
(74) *Attorney, Agent, or Firm* — Haynes and Boone, LLP

(57) ABSTRACT

An apparatus and method for creating axial movement of a drill string using a variable valve and a controller. In some embodiments, the controller is a proportional-integral-derivative controller.

19 Claims, 8 Drawing Sheets

(56) References Cited

U.S. PATENT DOCUMENTS

| | | | | |
|---|---|---|---|---|
| 5,438,170 | A * | 8/1995 | Klaveness | G01V 1/137 181/106 |
| 5,884,716 | A | 3/1999 | Beasley | |
| 6,102,138 | A | 8/2000 | Fincher | |
| 6,315,063 | B1 | 11/2001 | Martini | |
| 6,736,223 | B2 | 5/2004 | Odell, II et al. | |
| 7,273,109 | B2 | 9/2007 | Moore et al. | |
| 7,921,937 | B2 | 4/2011 | Brackin et al. | |
| 8,230,912 | B1 | 7/2012 | Connell | |
| 2001/0045300 | A1 | 11/2001 | Fincher et al. | |
| 2005/0194183 | A1 | 9/2005 | Gleitman et al. | |
| 2005/0230101 | A1 | 10/2005 | Zheng et al. | |
| 2009/0277687 | A1 | 11/2009 | Lee | |
| 2010/0310384 | A1 | 12/2010 | Stephenson et al. | |
| 2012/0048619 | A1 | 3/2012 | Seutter et al. | |
| 2015/0233238 | A1 * | 8/2015 | Logan | E21B 47/18 367/84 |

OTHER PUBLICATIONS

Supplementary Partial European Search Report issued by the European Patent Office regarding International application No. EP 14 87 9611, dated Aug. 21, 2017, 7 pages.

* cited by examiner

VARIABLE VALVE AXIAL OSCILLATION TOOL

FIELD OF THE DISCLOSURE

The present disclosure relates, in general, to equipment used in conjunction with bore hole drilling operations, and in particular, to controlling an axial oscillation tool using a variable valve.

BACKGROUND

Oil wells and gas wells are typically drilled by a process of rotary drilling. An earth-boring drill bit is mounted on the lower end of a drill string. Weight is applied on the drill bit, and the bit is rotated by rotating the drill string at the surface, by actuation of a downhole motor, or both. The rotating drill bit includes cutting elements that engage the earthen formation to form a borehole. The bit can be guided using an optional directional drilling assembly located downhole in the drill string, to form the borehole along a predetermined path toward a target zone. Hydrocarbon recovery wells can be drilled thousands of feet into the ground.

A bottom hole assembly (BHA) connected to a lower end of a drill string may include a drill bit, a motor to rotate the drill bit, and an axial oscillation tool to provide axial movement of the BHA and/or drill string. An exemplary arrangement uses a positive displacement motor (e.g., a "mud motor" or a "drilling motor") which is capable of rotating the drill bit even while the drill string does not rotate. For example, in directional drilling operations using a mud motor with a bent housing, the entire drill string including the bent housing, and the drill bit, may be rotated together to drill a straight section. To drill a deviated section, rotation of the drill string may be ceased with the bent housing at a selected rotational orientation, while the drill bit is rotated using just the mud motor. In these systems, high pressure drilling fluid, conventionally referred to as "drilling mud," is conveyed to the BHA through the drill string. After passing through the BHA, the mud exits through nozzles located in the drill bit and the mud flows back to the surface via an annulus formed between the drill string and a bore hole wall. The mud motor and the axial oscillation tool use the mud flowing through the drill string as their power source.

Drilling without rotation of the drill string may be referred to as sliding, since the non-rotating drill string essentially slides while the borehole is drilled using just the mud motor. The drill string often contacts the bore hole wall while downhole. If an interval of the drill string is moving relative to the bore hole wall, the interval is in a dynamic friction mode and a dynamic friction force is acting upon the interval. If the interval of the drill string is not moving relative to the bore hole wall, the interval is in a static friction mode and a static friction force is acting upon the interval. When the drill string is rotated, the interval is in dynamic friction mode because the drill string is moving relative to the bore hole wall. When the drill string is sliding without rotating, the interval can enter the static friction mode easier than when it is rotating. Because static friction coefficients are typically higher than dynamic friction coefficients, more weight is required to move or unstick the interval of the drill string when the interval is in the static friction mode than when the interval is in the dynamic friction mode. Without a smooth weight transfer to the drill bit, which is associated with the interval being in the dynamic friction mode, the elasticity of the drill string permits a buildup of downward force at a point, or an interval, in the drill string other than the drill bit. When the downward force overcomes the static friction force at the point, or the interval, in the drill string (i.e., unsticks the interval), there is a sudden transfer of downward force transmitted further down the drill string. This results in a lurching or a spike of applied force on the drill bit, which reduces the control the well bore drilling direction.

The bent sub of a mud motor is coupled to the drill string in a position associated with the desired drilling direction before the bent sub is placed downhole. When weight is applied to the drill-bit-and-rock-interface on the bottom of the hole, the tilt of the drill bit encourages the bore hole to be drilled in the direction of the tilt, or toolface direction. The spike of applied force—due to the unsticking of the interval—can also result in a sudden increase in an applied torque on the drill-bit-and-rock-interface, which can cause a reactive twist in the drill string, including the bent sub. Large angular oscillations of the toolface direction are created due to the sudden increase in the applied torque, and control of the drilling direction is lost. The spikes can stall and damage the drilling motor, which results in time spent replacing or repairing the drilling motor. Further, the large angular oscillations can create damaging vibrations in the BHA, which can damage sensors and electronics in down hole tools. This also results in time spent replacing or repairing the downhole tools.

In order to prevent the spike of applied force that often results from the unsticking of the interval—and associated reduced steering ability and possible tool damage—axial loading of the drill string is varied, using the axial oscillation tool, in a cyclical manner. This cyclical axial loading causes continuous longitudinal movement or axial vibration of at least a portion of the drill string and thereby maintains at least a portion of the drill string, or the interval, in the dynamic friction mode.

Often, more than one axial oscillation tool is located in the drill string. Each axial oscillation tool may be positioned along the drill string as the drill string is extended into the bore hole. This allows for each axial oscillation tool to create oscillatory axial drill string vibrations within at least a portion of the drill string. As each axial oscillation tools extends downhole, it passes through multiple areas of the bore hole, with some areas prone to cause sticking that may require larger mud pressure differentials to be created by the axial oscillation tool. As the bore hole lengthens, each axial oscillation moves relative to the bore hole through the multiple areas of the bore hole, with some areas not prone to cause sticking. Additionally, drilling conditions vary such as, for example, the tortuosity of the bore hole changes or the mud is replaced with a mud that has a higher friction coefficient. Without being able to modify operating parameters of each axial oscillation tool while it is downhole, the operating parameters for each axial oscillation tool are set (at the surface) to create large mud pressure differentials so that oscillatory axial drill string vibrations are created in the areas prone to cause sticking. However, this can result in each axial oscillation tool creating large mud pressure differentials in the areas that are not prone to sticking.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DESCRIPTION OF ILLUSTRATIVE EMBODIMENTS

Figure 1:
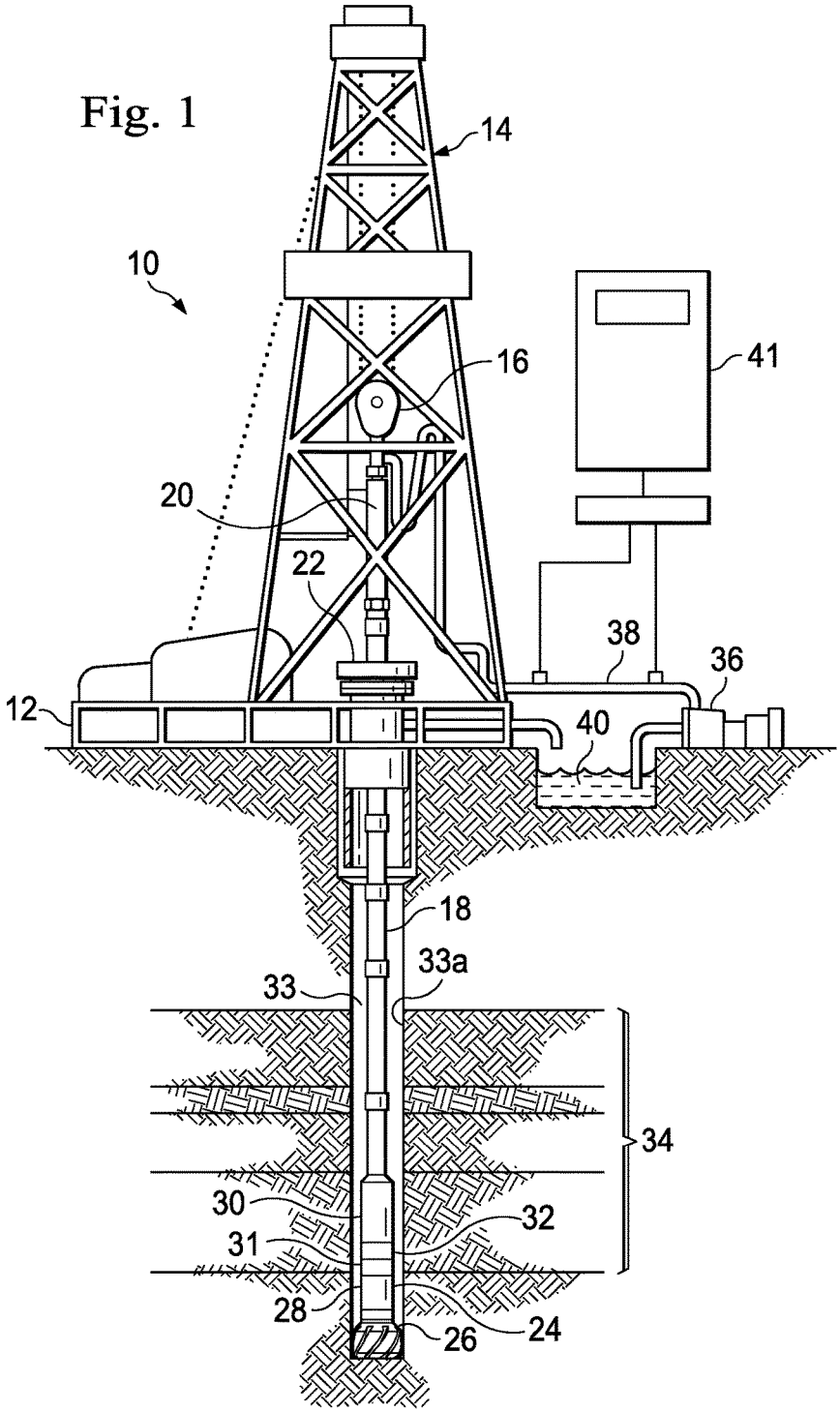
FIG. 1 is a schematic illustration of a drilling rig implementing a variable valve axial oscillation tool in a well according to an embodiment of the present disclosure.

Illustrative embodiments and related methods of the present disclosure are described below as they might be employed in a variable valve axial oscillation tool and method of operating the same. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the tool, or the apparatus, in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Referring initially to FIG. 1, a drilling rig is schematically illustrated and generally designated 10. A drilling platform 12 that is equipped with a derrick 14 supports a hoist 16 for raising and lowering a drill string 18. The hoist 16 suspends a top drive 20 suitable for rotating the drill string 18 and lowering it through a well head 22. Connected to the lower end of the drill string 18 is the bottom hole assembly (BHA) 24. The BHA 24 may include a drill bit 26; a mud motor 28 that can incorporate a bent housing; a variable valve axial oscillation tool 30; a measurement tool such as, for example, a measurement while drilling (MWD)/logging while drilling (LWD) system 31; and a telemetry system 32. In some embodiments, the BHA 24 also includes a weight on bit (WOB) sensor (not shown) and a torque on bit (TOB) sensor (not shown).

As the drill bit 26 rotates, it creates a bore hole 33 having a bore hole wall 33*a* that passes through various formations 34. A pump 36 circulates a drilling fluid, such as a mud, through a supply pipe 38 to the top drive 20, down through the interior of the drill string 18, through orifices in the drill bit 26, back to the surface via the annulus around the drill string 18, and into a retention pit 40. The mud motor 28 communicates with a surface system 41 through the use of the telemetry system 32 such as, for example, a mud pulse, an electromagnetic, an acoustic, a torsion, or a wired drill pipe telemetry system.

Generally, an axial drag force and an axial friction force are present between the drill string 18 and the bore hole wall 33*a*. In some embodiments, the tool 30 creates axial movement of the drill string 18, which can include the BHA 24, relative to the bore hole wall 33*a* to reduce the axial drag force and the axial friction force. The reduction of the axial drag force and the axial friction force that is exerted on the drill string 18 increases the control of steering of the BHA 24.

In some embodiments, the tool 30 is placed directly above the mud motor 28. However, the tool 30 can be placed anywhere along the drill string 18. In some embodiments, a plurality of tools 30 can be placed along the drill string 18. For example, the plurality of tools 30 may be spaced along the drill string 18 when a well path of a well is long, highly tortuous, and approaching a horizontal inclination.

In some embodiments, a location of the tool 30 within the drill string 18 is based on anticipated conditions or contingent conditions in the bore hole 33 and preferably determined before any portion of the drill string 18 is placed into the bore hole 33. Determining the location before any portion of the drill string is placed downhole avoids having to extract at least a portion of the drill string 18 to insert the tool 30 into a point in the drill string 18 while tripping into the bore hole 33. Often, the proposed trajectory of the well path is examined and an expected drag force and an expected friction force are calculated for at least a portion of interest of the bore hole 33 during pre job planning activities associated with the well. Friction and drag factors, which affect the friction force and/or the drag force, include any one or more of a drill pipe weight per unit distance; a drill pipe density per unit distance; a drill pipe tool joint shape; a mud type; a mud density; a mud viscosity; an expected cutting bed length; tortuosity (accumulative and localized curvature) of the bore hole 33; inclination from vertical of the bore hole 33; formation properties such as, for example, a compressive strength of the formations 34 or a likelihood of key seating the drill string 18; the type of the drill bit; and a profile of the bore hole 33; a pressure and/or a porosity of the formations 34; and the likelihood of differential sticking. The expected drag force and/or the expected friction force are used to analyze and to model how the expected drag force and/or the expected friction force will be distributed over the length of the drill string 18 as the length of the drill string 18 increases. In some embodiments, the analysis and modeling includes creating drilling simulations on a computer, or other computational devices, to identify an ideal location for the tool 30 within the drill string 18. Additional tool placement factors are considered to determine the ideal location for the tool 30 within the drill string 18. These additional tool placement factors include one or more of a plurality of drilling parameters such as, for example, a flow rate, a required weight on bit, and a formation friction coefficient (static and dynamic); the presence of cuttings bed build-ups; partial formation collapse areas; an internal pipe pressure (which effects pipe stiffness); a drill string geometry such as, for example, diameters and changes in diameters; a drill string segment type such as, for example, regular drill pipe, heavy weight drill pipe, drill collars and BHA sections; the location of the drill string segment type; a buoyancy factor; the inclination of the bore hole 33; the diameter of the bore hole 33; the curvature or tortuosity of the bore hole 33; the smoothness of the surface of the bore hole wall 33*a*; a rock abrasion resistance (resistance to key seating); a tendency for differential sticking against the bore hole wall 33*a*; factors relating to the mud such as, for example, a mud lubricity, a mud weight, a mud reactiveness to formations; a pipe buoyancy; and the "stickiness" of the formations 34 to the drill string 18 such as for example, a stickiness of a clay that that forms a portion of the formations 34.

In some embodiments, the ideal location for the tool 30 is based on monitored conditions during drilling operations and determined after a portion of the drilling string 18 is placed in the bore hole 33. The monitored conditions are used to determine the ideal location of the tool within a future portion of the drill string 18 or within an existing portion of the drill string 18. In some embodiments, the tool 30 is placed at the ideal location within the existing portion of the drill string 18 during subsequent bit runs into the same bore hole 33, which provide an opportunity to reposition, remove, or add the tool 30 to the drill string 18. In some embodiments, the monitored conditions relate to any of the friction and drag factors and the additional tool placement factors as listed above.

Additionally, and in some embodiments, the ideal location of the tool 30 within the drill string 18 is also affected by local compression or local tension of the drill string 18 and the axial elasticity of the drill string 18. For example, in a horizontal well, an interval of the drill string 18 that is in a vertical section of the bore hole 33 is generally in tension, while an interval of the drill string 18 that is in a horizontal section of the bore hole 33 is generally in compression. Generally, the axial drag force exerted on an interval in the vertical section of the bore hole 33 is less than the axial drag force exerted on an interval in the horizontal section of the bore hole 33. Regardless, the tool 30 is located along the drill string 18.

Figure 2A:
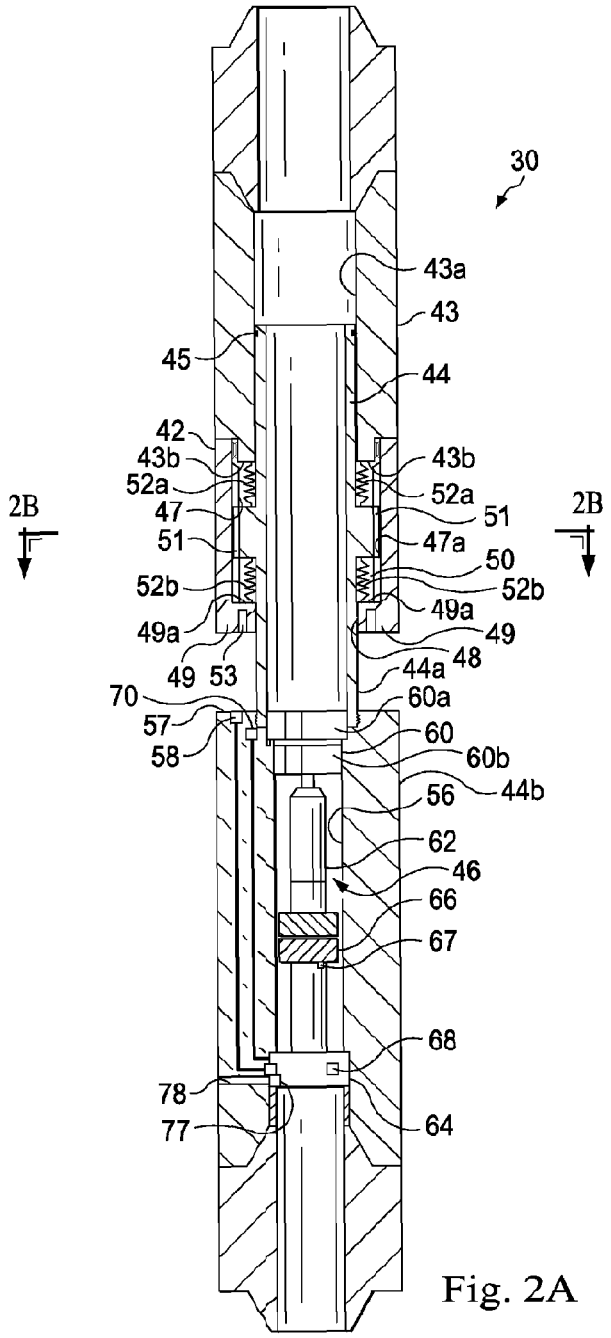
FIG. 2A is a cross-sectional view of the variable valve axial oscillation tool of FIG. 1, according to some embodiments, the variable valve axial oscillation tool including a valve and a controller.
Figure 2B:
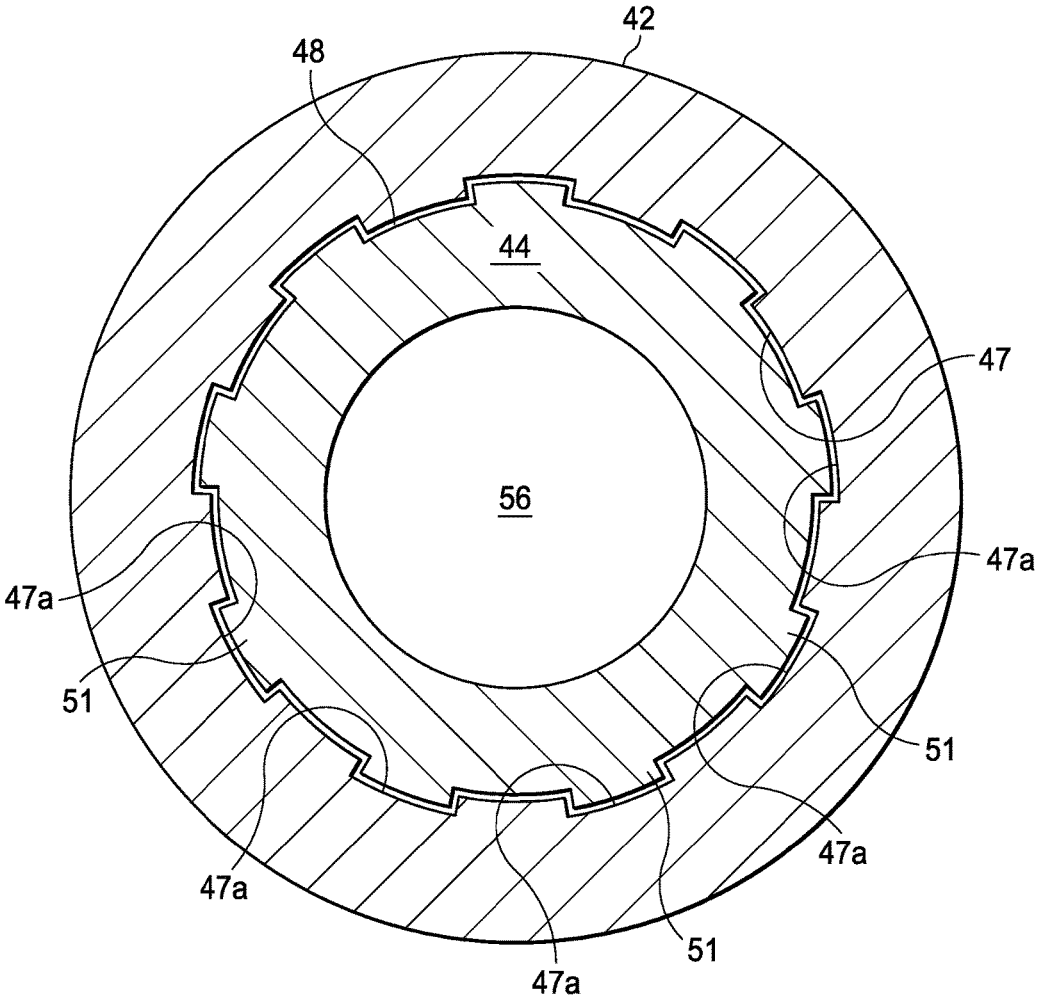
FIG. 2B is another cross-sectional view of the variable valve axial oscillation tool of FIG. 1, according to some embodiments.

In some embodiments, and as shown in FIGS. 2A and 2B, the tool 30 includes an upper tubular member, such as a spline sleeve 42 that is connected to an upper sub or hang off sub 43; a lower tubular member, such as a lower sleeve 44; and a valve assembly 46 engaged therewith or disposed therein, which components will be described in greater detail below. The hang off sub 43 has an interior surface that forms a passageway 43*a*. The passageway 43*a* receives mud and a portion of the lower sleeve 44. The hang off sub 43 is concentrically disposed about an exterior surface of the lower sleeve 44 and is attached to the spline sleeve 42 using a threaded connection. It should be noted that, while a threaded connections is noted here and throughout in various exemplary embodiments, any suitable fastener may be selected. A seal 45 is concentrically disposed about the exterior surface of the lower sleeve 44 and between the lower sleeve 44 and the hang off sub 43. In some embodiments, the seal 45 is a sliding seal. However, the seal 45 can be any type of seal such as, for example, an o-ring seal or a Polypak® seal manufactured by Parker Hannifin Corp. In some embodiments, the seal 45 includes wipers (not shown) to sweep surfaces on one or both sides of a seal arrangement to keep particles away from the seal 45. The seal 45 may also include back up rings (not shown) to aid in maintaining the seal pressure capability. The seal 45 prevents, or limits the amount of, the mud from entering the cavity 50. The spline sleeve 42 is concentrically disposed about the exterior surface of the lower sleeve 44. The spline sleeve 42 has an interior surface 47 that defines an internal passage 48. The interior surface 47 also forms a plurality of circumferentially-positioned, axially extending channels 47*a*. The spline sleeve 42 also has a lower portion 49 that extends inward radially to form a shoulder face 49*a*. The shoulder face 49*a*, the interior surface 47, and a lower face 43*b* of the hang off sub 43 at least partially define a cavity 50. In some embodiments, the seal 45 may be placed between the shoulder 49 and the exterior surface of the lower sleeve 44. In some embodiments, the tool 30 includes a plurality of seals 45. In some embodiments, the plurality of seals 45 are positioned such that a space or an internal area between the plurality of seals 45 may be pressure balanced. In some embodiments, the space or the internal area between the plurality of seals 45 may be pressure balanced to a pressure that is substantially the same or equal to a local inner pressure of the drill string 18 or a local annular pressure between the well bore wall 33*a* and the tool 30.

A plurality of circumferentially-positioned, axially extending splines 51 extend radially from the lower sleeve 44 and are accommodated within the cavity 50. Specifically, the plurality of splines 51 are accommodated within the plurality of channels 47*a* to transfer drill string torque between the spline sleeve 42 and the lower sleeve 44. Springs 52*a* and 52*b* are concentrically disposed about the exterior surface of the lower sleeve 44. The springs 52*a* are axially disposed between the splines 51 and the lower face 43*b* of the hang off sub 43, and the springs 52*b* are axially disposed between the splines 51 and the shoulder face 49*a*. The axial movement of the splines 51 relative to the spline sleeve 42 defines a tool stroke length, which is limited in the axial direction by the shoulder face 49*a*, the lower face 43*b*, and by the maximum spring compression of springs 52*a* and 52*b*. Each tool stroke length is associated with a tool stroke time interval in a tool stroke direction. A magnet source 53 is disposed within the lower portion 49.

In some embodiments, the internal area between the plurality of seals 45 is defined in part by at least one seal 45 from the plurality of seals 45 that is disposed above the splines 51 and by at least one seal 45 from the plurality of seals 45 that is disposed below the splines 51. A pressure balance system (not shown) may be used to maintain an internal pressure of the internal area. In some embodiments, the internal pressure is substantially the same as the inner pressure of the drill string 18 or the annular pressure.

In some embodiments, the cavity 50 has an upper portion, in which the springs 52*a* are located, separated from a lower portion, in which the springs 52*b* are located, by the splines 51. In some embodiments, the flow of a fluid or a gas between the upper portion and the lower portion is a function of a clearance measurement between the interior surface 47 of the spline sleeve 42 and an exterior surface of the splines 51. Altering the clearance measurement can increase or restrict the flow between the upper portion and the lower portion. In some embodiments, restricting the flow between the upper portion and the lower portion dampens the response (lower sleeve 44 movement relative to the spline sleeve 42) to sudden shock loads applied by the valve 60 (e.g., loads associated with a tool stroke jerk, as described below) or sudden shock loads that are transferred to the tool 30 through the drill string 18. That is, the clearance measurement and associated flow restriction or flow increase function as a shock absorber for the tool 30.

The lower sleeve 44 has an interior surface that forms an internal passage 56 that receives the mud. The internal passage 56 extends from a top of the lower sleeve 44 to the bottom of the lower sleeve 44 so that mud passes through the lower sleeve 44. The lower sleeve 44 has a collar 57 located below the splines 51. As the splines 51 of the lower sleeve 44 move away from the lower face 43*b*, the springs 52*b* are compressed, the springs 52*a* are stretched, and the distance between the lower portion 49 and the collar 57 increases. Similarly, as the splines 51 of the lower sleeve 44 move towards the lower face 43*b*, the springs 52*a* are compressed, the springs 52*b* are stretched, and the distance between the lower portion 49 and the collar 57 decreases. The static tension or compression associated with the springs 52*a* and 52*b* can be adjusted before the drill string 18 is placed downhole, or while the tool 30 is downhole in response to the conditions in the bore hole 33. In some embodiments, the springs 52*a* and 52*b* may be one or more of a coil spring, a wave spring, a Belleville spring or arrangement of a plurality of Belleville springs, or any other spring type or combination or plurality thereof. In some embodiments, the lower sleeve 44 includes an upper portion 44*a* and a separate lower portion 44*b*. The upper portion 44*a* includes at least the splines 51. In some embodiments, the lower portion 44*b* includes the collar 57. A lower end of the upper portion 44*a* and an upper end of the lower portion 44*b* are threaded to create a threaded connection between the upper portion 44*a* and the lower portion 44*b*. It should be noted that, while threaded connections are noted here and throughout in various exemplary embodiments, any suitable fastener may be selected. In some embodiments and during the assembly of the tool 30, the spline sleeve 42 slides upwards over the lower portion of the upper portion 44*a* and attaches to the hang off sub 43 so that the splines 51 are disposed within the cavity 50. The upper portion 44*a* is then attached to the lower portion 44*b*.

A proximity sensor 58 is located in the collar 57 such that it is aligned with the magnet source 53. As the collar 57 moves away from the lower portion 49 in the axial direction, the strength of the magnetic field from the magnet source 53, as detected by the proximity sensor 58, is reduced. As the collar 57 moves toward the lower portion 49, the strength of the magnetic field from the magnet source 53, as detected by the proximity sensor 58, is increased. Therefore, the strength of the magnetic field from the magnet source 53, as detected by the proximity sensor 58, corresponds to an axial distance between the collar 57 and the lower portion 49. The tool stroke length can be determined upon a review or sampling, using the proximity sensor 58, of the axial distance between the collar 57 and the lower portion 49. In some embodiments, the proximity sensor 58 is a Hall effect sensor. In some embodiments, the magnet source 53 and the proximity sensor 58 can be omitted and any type of proximity sensing system or distance measurement system could be used to measure the distance between (or relative movement between) the lower sleeve 44 and the spline sleeve 42 and/or the lower sleeve 44 and the hang off sub 43. In some embodiments, the proximity sensing system or the distance measurement system is an acoustic sensor or a linear variable differential transformer (LVDT) such as, for example, a Differential Variable Reluctance Transducer. However, in some embodiments, the proximity sensing system or the distance measurement system is positioned at any location within or on the tool 30 where a positional difference between the spline sleeve 42 and the lower sleeve 44 is detectable or where a positional difference between the hang off sub 43 and the lower sleeve 44 is detectable. For example, the sensor 58 may be located anywhere on the lower sleeve 44, such as along a portion of the lower sleeve 44 that is concentrically disposed within the spline sleeve 42 or the hang off sub 43. For example, the magnet 53 may be located along the interior surface 47 of the spline sleeve 42 and the sensor 58 may be located in the portion of the lower sleeve 44 that is concentrically disposed within the spline sleeve 42. Alternatively, the magnet 53 may be located near the interior surface of the hang off sub 43 and the sensor 58 may be located in the portion of the lower sleeve that is concentrically disposed within the hang off sub 43.

Figure 3:
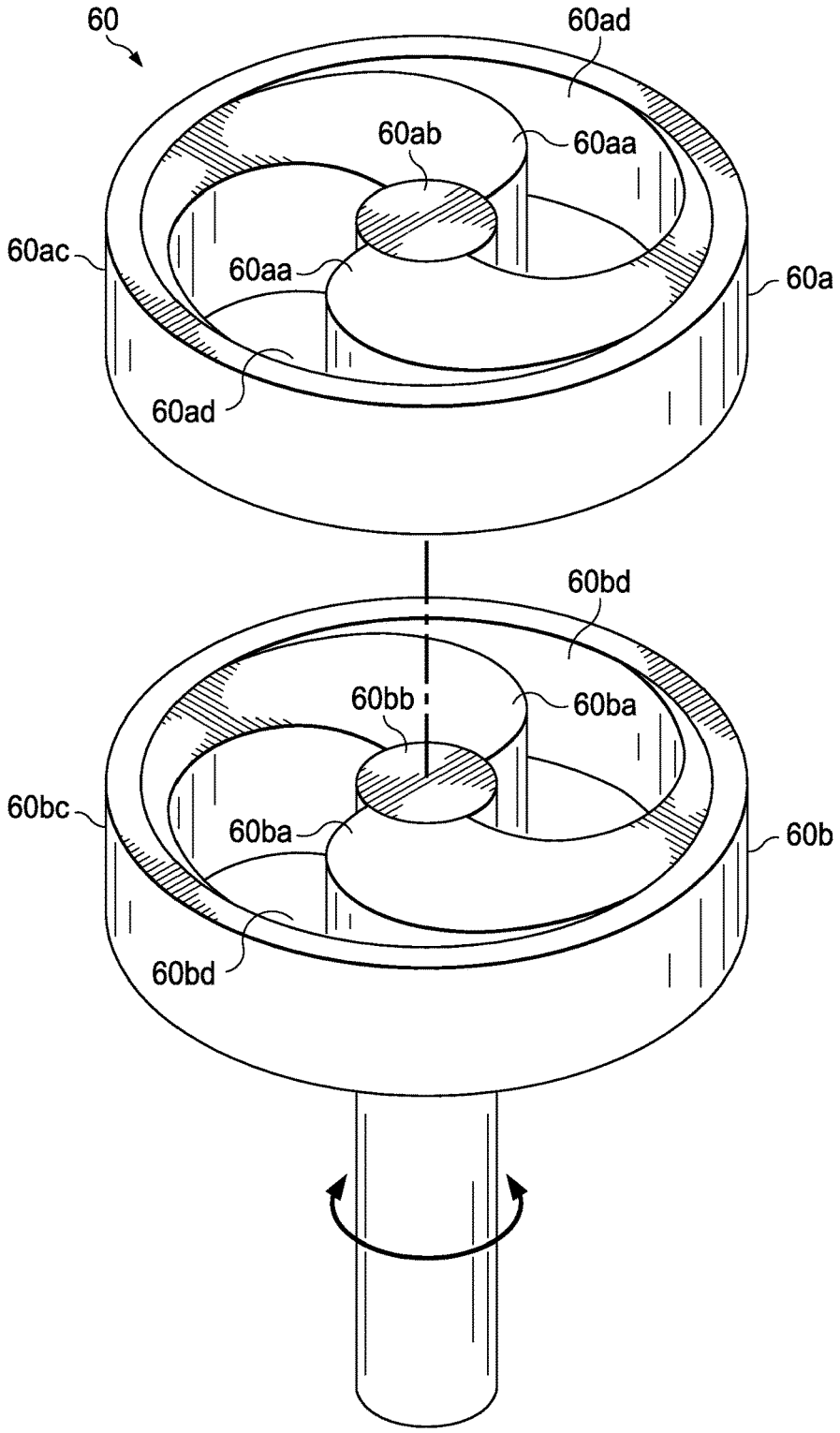
FIG. 3 is an exploded view of the valve of FIG. 2, according to some embodiments.

In some embodiments, the valve assembly 46 is located within the internal passage 56 and includes a valve 60, coupled to a servomechanism ("servo") 62 that communicates with and controls the position (e.g., open, partially open, closed, partially closed) of the valve 60 and the rate of change of the position of the valve 60. In some embodiments, the servo 62 controls the precise position of the valve 60 and permits incremental positional control of the position of the valve 60. In some embodiments, the positioning of the valve 60 is performed using a plurality of fixed incremental steps, which are monitored and controlled. In some embodiments, the servo 62 can lock or hold the valve 60 in the desired position until the servo 62 receives instructions or a command to move the valve 60 to another position. That is, the servo 62 physically controls the position of the valve 60. In some embodiments, the servo 62 includes an electric motor. However, a hydraulic motor may be included in the servo 62 instead. FIG. 3 shows an exploded view of the valve 60, in which the valve 60 includes a stator 60*a* and a rotor 60*b*. The stator 60*a* is generally stationary relative to the tool 30 and may have a profile that prevents or limits movement of the stator 60*a* relative to the tool 30. In some embodiments, the stator 60*a* includes a plurality of circumferentially-positioned, axially extending splines (not shown) that extend radially from the stator 60*a* and that are accommodated within circumferentially-positioned, axially extending channels (not shown) located on the interior surface of the lower sleeve 44. Alternatively, the stator 60*a* is coupled to the lower sleeve 44 so that the stator 60*a* does not rotate relative to the lower sleeve 44 in a variety of ways such as, for example, using a locking pin and a socket, a weld, a threaded connection, a spacer, etc. The stator 60*a* has blades 60*aa* extending radially from a middle portion 60*ab* of the stator 60*a* and towards the perimeter 60*ac* of the stator 60*a*. The stator 60*a* also forms passageways 60*ad* through the stator 60*a* to allow the mud to flow through the passageways 60*ad*. The rotor 60*b* moves relative to the stator 60*a* and has blades 60*ba* extending radially from a middle portion 60*bb* of the rotor 60*b* and towards the perimeter 60*bc* of the rotor 60*b*. The rotor 60*b* also forms passageways 60*bd* through the rotor 60*b* to allow the mud to flow through the passageways 60*bd*. The degree of alignment of the passageways 60*ad* and 60*bd* is associated with the position of the valve 60. That is, when the passageways 60*ad* and 60*bd* are fully aligned, the valve 60 is considered to be fully open and when the passageways 60*ad* and 60*bd* are only partially aligned, the valve 60 is considered to be partially closed. However, the valve 60 may be any type of variable valve, such as, for example, any one of a gated iris valve, a shutter valve, a poppet valve, a bean choke valve, a ball valve, a butterfly valve, a globe valve, a check valve, a piston valve, and a rotational valve. In some embodiments, the valve 60 has a singular passageway. In another exemplary embodiment, the valve 60 has a plurality of passageways with a portion of the plurality of passageways in a fixed position and a portion of the plurality of passageways having variable positions. In some embodiments, the valve 60 is configured so that when the valve 60 is partially closed or fully closed, an increase in the pressure differential occurs across the valve 60. That is, when the valve 60 is partially closed or fully closed, the flow of mud through the interior of the drill string 18 is restricted or stopped and the pressure on a top side of the valve 60 is greater than the pressure on a bottom side of the valve 60.

Referring back to FIG. 2, and due to the pressure differential across the valve 60, the collar 57 of the lower sleeve 44 moves downward—relative to the spline sleeve 42—to increase the distance between the lower portion 49 and the collar 57. The springs 52*b* are compressed when the collar 57 moves downwards. When the valve 60 is partially opened or fully opened, the pressure differential decreases and an upward thrust force from the springs 52*b* force the splines 51 of the lower sleeve 44 upwards to compress the springs 52*a*, thereby decreasing the distance between the lower portion 49 and the collar 57. In some embodiments, valve operating parameters define the operation of the valve 60 and therefore, the movement of the lower sleeve 44 relative to the spline sleeve 42. The valve operating parameters include one or more of the position of the valve at a maximum open position, the position of the valve at a maximum closed position, an interval of time between the maximum open position and the maximum closed position, a rate of change between the maximum open position and the maximum closed position or between the maximum closed position and the maximum open position, and a variable rate of change between the maximum open position and the maximum closed position or between the maximum closed position and the maximum open position. That is, the valve operating parameters control and/or include at least the first order derivative (i.e., valve positioning speed or valve positioning velocity) and the second order derivative (i.e., valve positioning acceleration) of the valve position (e.g., the maximum open position and the maximum closed position). In some embodiments, the valve operating parameters also control and/or include higher order derivatives, such as a third order derivative of the valve position (i.e., valve position impulse or valve position jerk), which is the rate of change of acceleration. In some embodiments and as described above, the operation of the valve 60 affects the position of the lower sleeve 44 relative to the spline sleeve 42. Therefore, the valve operating parameters also control or affect at least the first, the second, and the third order derivative of the position of the lower sleeve 44 relative to the spline sleeve 42. That is, the valve operating parameters control a tool stroke velocity, a tool stroke acceleration, and the tool stroke jerk. In some embodiments, the valve 60 is controlled to create a specific valve position impulse and therefore, a corresponding tool stroke jerk in order to unstick or jar loose an interval of the drill string 18 that is stuck. The valve operating parameters correspond with at least the tool stroke length, the tool stroke velocity, the tool stroke acceleration, and a tool stroke frequency of the tool 30. Operation of the valve 60 creates movement or vibration—relative to the bore hole wall 33*a*—of at least a portion of the drill string 18 surrounding the tool 30. That is, the operation of the valve 60 creates localized axial movement of a portion of the drill string 18 surrounding the tool 30.

In some embodiments, the valve assembly 46 also includes a controller 64 that communicates with the proximity sensor 58, the servo 62, and a turbine 66. The controller 64 is located within the tool 30 such that the mud flows through longitudinal flow paths formed or partially formed in an exterior surface of the controller 64 to permit the mud to flow down the interior of the drill string 18 or up the drill string 18. That is, the controller 64 does not significantly impede the flow of the mud through the drill string 18. In some embodiments, the controller 64 communicates with the proximity sensor 58 to receive the strength of the magnetic field, as detected by the proximity sensor 58, thereby allowing the controller 64 to monitor the position of the spline sleeve 42 relative to the lower sleeve 44 and to determine the tool stroke length, the tool stroke velocity, and the tool stroke acceleration over each stroke time interval and stroke direction.

In some embodiments, the turbine 66 powers the servo 62, the controller 64, and the proximity sensor 58. In some embodiments, the turbine 66 can be rotationally coupled, using a magnetic coupling (not shown), to an internal shaft (not shown) in the valve assembly 46 that is connected to an electric generator or a hydraulic pump, if required, to transfer at least a portion of the hydraulic energy from the flow of the mud in the drill string 18 to any hydraulic and/or electric systems in the tool 30. In some embodiments, this harnessed energy from the flow of the mud is used to power the valve assembly 46 to permit it to function. In some embodiments, the turbine 66 includes an addressable receiver so that the turbine 66 may communicate with the controller 64. In some embodiments, the turbine 66 and the controller 64 communicate through the addressable receiver using a binary pulse code. In some embodiments, the turbine 66 provides hydraulic and electric power to the tool 30. The valve assembly 46 also includes a sensor 67 to monitor the operation of the turbine 66. In some embodiments, the sensor 67 is attached to a stator of the turbine 66. In some embodiments, the sensor 67 is any proximity sensor that detects the presence or rotation of a blade or a rotor assembly of the turbine 66. The sensor 67 is in communication with the controller 64 and sends data to the controller 64, which determines the rotations per minute (RPM) of the turbine 66 based on data sent from the sensor 67 and based on a real-time clock or a timer. In another embodiment, the sensor 67 is a pressure sensor located along a hydraulic line that is connected to a hydraulic power generator and the sensor 67 detects pressure pulses in the hydraulic line where the pressure pulses correspond to the rotation of the blade or of the rotor assembly of the turbine 66. In yet another embodiment, the sensor 67 is located along an electrical line coupled to an electric generator and the sensor 67 detects an electrical ripple in the electrical line from the electrical generator where the electrical ripple corresponds to the rotation of the blade or of the rotor assembly of the turbine 66. The sensor 67 is powered by the turbine 66. In some embodiments, alternative power sources for the tool 30 are possible such as batteries; charged capacitors such as, for example, super capacitors or very high capacity capacitors configured to electrically power the tool 30; or other forms of energy storage or coupling systems. In some embodiments, alternative power coupling techniques are possible such as, for example, a plurality of magnets are mounted on the blade(s) or on the rotor assembly of the turbine 66 that pass over a plurality of pick-up coils in a body of the valve assembly 46.

The valve assembly 46 also includes a pressure sensor 68 in communication with the controller 64 and powered by the turbine 66. In some embodiments, the controller 64 may include the pressure sensor 68. The pressure sensor 68 measures the pressure of the mud passing through the lower sleeve 44 to determine a pressure amplitude of the mud that is associated with the pressure pulse of the mud. Alternatively, the controller 64 can infer the pressure amplitude in response to a change in the RPM of the turbine 66 as the valve 60 opens and closes, assuming the pump rate of the pump 36 is relatively constant.

The tool 30 also includes an axial load sensor, such as a strain sensor 70 located within the lower sleeve 44. The strain sensor 70 measures a thrust force on the lower sleeve 44 and is in communication with the controller 64. The controller 64 can use the thrust force, as measured by the strain sensor 70, to determine the pressure differential across the valve 60. In some embodiments, the strain sensor 70 is powered by the turbine 66. In some embodiments, additional strain sensors are located along the drill string 18. Each of the additional strain sensors is in communication with the controller 64 or another controller that is located near the each of the additional strain sensors. Communication between each of the additional strain sensors and the controller 64 or the another controller is via the communication device 76, the telemetry system 75, or another telemetry system. Each of the additional strain sensors measures a local tension or local compression associated with the location of each of the additional strain sensors along the drill string 18. In some embodiments, the position of each of the additional strain sensors in the drill string 18 can be used for calculating required axial force by the tool 30. The position of each of the strain sensors is pre-installed in the tool 30 prior to being placed downhole or is communicated to the tool 30 via the communication device 76 or the telemetry system 75 after the tool 30 has been placed downhole.

Figure 4:
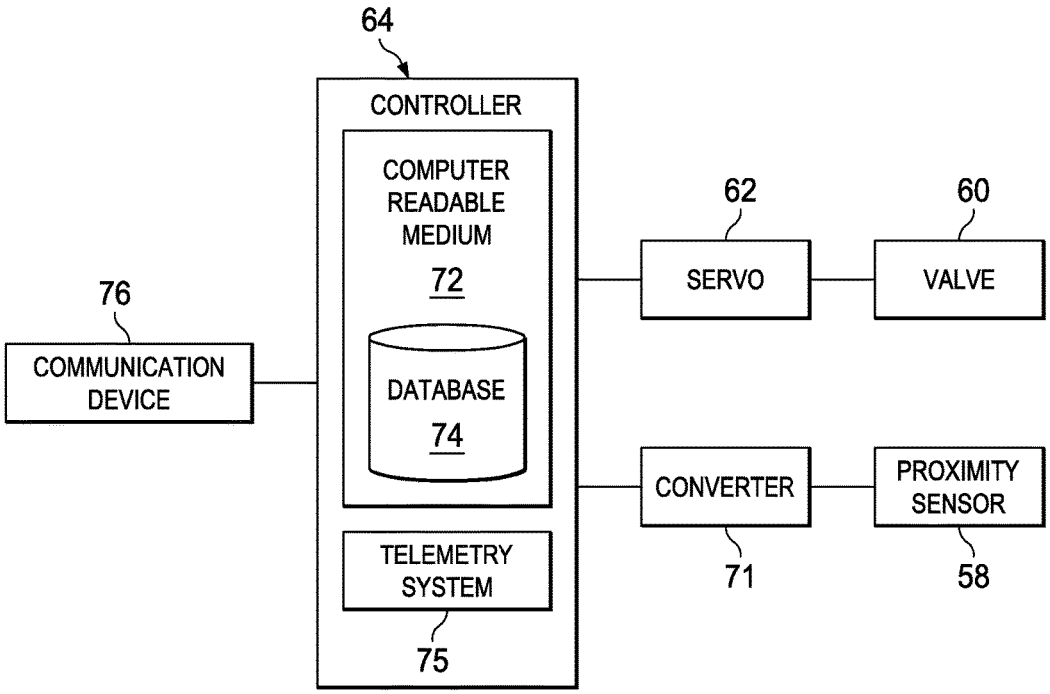
FIG. 4 is a diagrammatic illustration of a portion of the variable valve axial oscillation tool of FIG. 1, according to some embodiments.

In some embodiments and as shown in FIG. 4, the valve assembly 46 also includes a converter 71 that is in communication with the proximity sensor 58 and the controller 64. The converter 71 may be, for example, an analog to digital converter used to convert an analog signal created by the proximity sensor 58. In some embodiments, the converter 71 is powered by the turbine 66.

Figure 5:
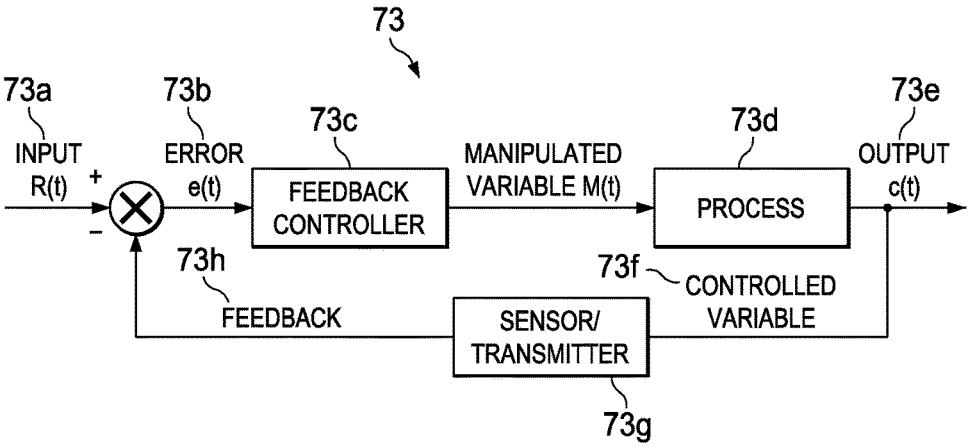
FIG. 5 is a diagrammatic illustration of a feedback control system of the variable valve axial oscillation tool of FIG. 1, according to some embodiments.

The controller 64 also includes a computer readable medium 72 operably coupled thereto. Instructions accessible to, and executable by, the controller 64 are stored on the computer readable medium 72. For example, instructions relating to a feedback control system 73 that is illustrated in FIG. 5, are stored on the computer readable medium 72. The feedback control system 73 has a input 73*a*, an error 73*b*, a feedback controller 73*c*, a process 73*d*, an output 73*e*, a controller variable 73*f*, a sensor/transmitter 73*g*, and a feedback 73*h*. Referring back to FIG. 4, a database 74 is also stored in the computer readable medium 72. A variety of feedback control theory data and drilling-related data may be stored in the database 74, such as for example, data relating to a model of the drill string 18, which may include the position of the tool 30 in the drill string 18 and the position of the additional strain sensors in the drill string 18, planned trajectories of the BHA 24, data relating to the formations 34, expected operating parameters and limitations of tools located in the drill string 18, a calculated spring force, a calculated damping force, a calculation relating to an expected oscillation distance of an interval of the drill string 18 in response to an axial force produced by the tool 30, and a calculated tool stroke length and a tool calculated stroke frequency projected to maintain or reach a predetermined WOB value and/or TOB value. In some embodiments, a WOB value is a value associated with the amount of tension force or compression force at a location on the drill string 18 at which a WOB sensor is located. In some embodiments, the TOB value is a value associated with the amount of torque exerted at a location on the drill string 18 at which a TOB sensor is located. The controller also includes a telemetry system 75. The controller 64 controls the valve 60, via the servo 62 and using the telemetry system 75, to create pressure pulses within the mud, which allows the tool 30 to communicate with the surface system 41.

The valve assembly 46 also includes an external communication device 76 that communicates with other down hole tools and/or the additional sensors and/or the surface system 41. The external communication device 76 may be a wired drill pipe network. The wired drill pipe network permits one way or bi-directional communication with the surface system 41; a down hole communications hub or a plurality of down hole communications hubs that act as addressable network nodes; drill string telemetry repeaters; other sensors such as, for example, axial load sensors, torque sensors, drill string bend and bend direction sensors; actuators; steering systems such as, for example, rotary steerable tools; and/or any other data communication or telemetry device located in the drill string 18, due to each being addressable on the wired drill pipe network, to allow the exchange of data between the downhole tools. In some embodiments, the valve assembly 46 receives data or information such as, for example, data associated with a measured WOB and/or a measured TOB from the surface system 41 via the communication device 76 or a measured WOB and/or a measured TOB from the WOB sensor and/or the TOB sensor of the BHA (not shown). In some embodiments, the valve assembly 46 also receives data from one or more additional WOB sensors and/or additional TOB sensors that are located at any intermediate point in the drill string 18. In some embodiments, the valve assembly 46 receives data from a sensor that is located along the interval of the drill string 18 that the tool 30 is capable of oscillating. In some embodiments, the communication device 76 is powered by the turbine 66 and is in communication with the controller 64.

In some embodiments, the controller 64 includes a proportional-integral-derivative (PID) controller function, which is also known as a closed loop feedback controller. In some embodiments, the controller 64 contains a function to control the valve position jerk and thereby the tool stroke jerk. The PID controller 64 controls the position of the valve 60 via the servo 62. In some embodiments, the PID controller 64 sends instructions or commands to the servo 62. In some embodiments, the plurality of fixed incremental steps used by the servo 62 to control the valve 60 is monitored in binary steps by a binary position counter in the controller 64. In some embodiments, the controller 64 uses a proportional control system (difference in pressure differential and the tool stroke length), an integral control system (associated with a frequency or a duty cycle for valve on duration), and a derivative control system (rate of change from a valve start position to a valve end position). Other control systems and methods can be used to vary the response to sensed or measured downhole conditions that are received from the strain sensor 70 or the additional strain sensors. For example, a calculated maximum pressure differential can be determined based on: an amount of axial oscillation required to maintain the drill string interval in a oscillatory motion; a measured drag force (measured using the strain sensor 70 or one of the additional strain sensors) or a calculated drag force; and/or a response from a WOB sensor, to ensure that at least the interval is in the dynamic friction mode. In some embodiments, the controller 64 is a two-degree-of-freedom control system. In some embodiments, the controller 64 is a PID controller with the tool stroke length as one degree of freedom, the tool stroke frequency as another degree of freedom, and the predetermined WOB as a set point.

Referring back to FIG. 2 and in some embodiments, the tool 30 also includes a pressure sensor 77. A passage 78 is formed in the lower sleeve 44 that extends between the pressure sensor 77 and the exterior surface of the lower sleeve 44. The pressure sensor 77 is in fluid communication with the annulus and measures an annular pressure between the bore hole wall 33*a* and the exterior surface of the lower sleeve 44. In some embodiments, the pressure sensor 77 is powered by the turbine 66 and is in communication with the controller 64. The controller 64, in response to receiving the annular pressure measured by the pressure sensor 77, determines whether oscillation of the tool 30 is creating a "surge" or "swab" pressure on the formations 34 due to a piston effect created from the axially moving drill string 18. In some embodiments, the controller 64—based on the annular pressure measured by the pressure sensor 77—reduces or increases the tool stroke length to maintain a predetermined pressure threshold (e.g., the equivalent circulating density within the pore pressure and fracture gradient limits of the bore hole).

Figure 6:
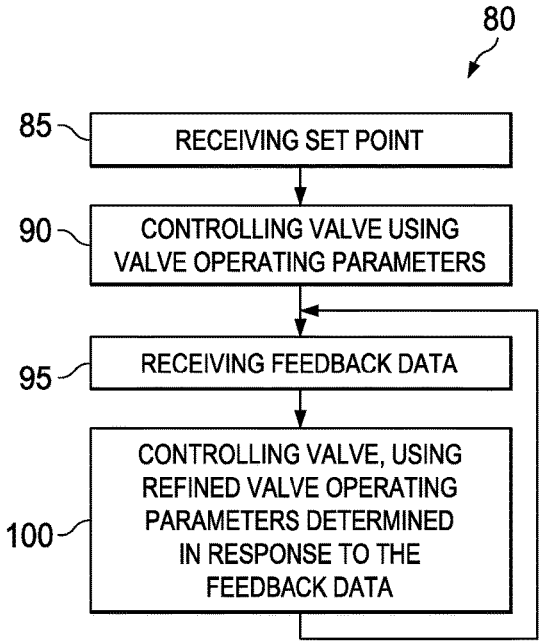
FIG. 6 illustrates a method of operating the variable valve axial oscillation tool of FIG. 1, according to some embodiments.

In some embodiments, as illustrated in FIG. 6 with continuing reference to FIGS. 1-5, a method of operating the tool 30 is generally referred to by the reference numeral 80 and includes receiving a set point value at step 85, controlling the valve 60, using the valve operating parameters, at step 90, receiving feedback data at step 95, and controlling the valve 60, using refined valve operating parameters that are determined in response to the feedback data, at step 100.

Figure 7:
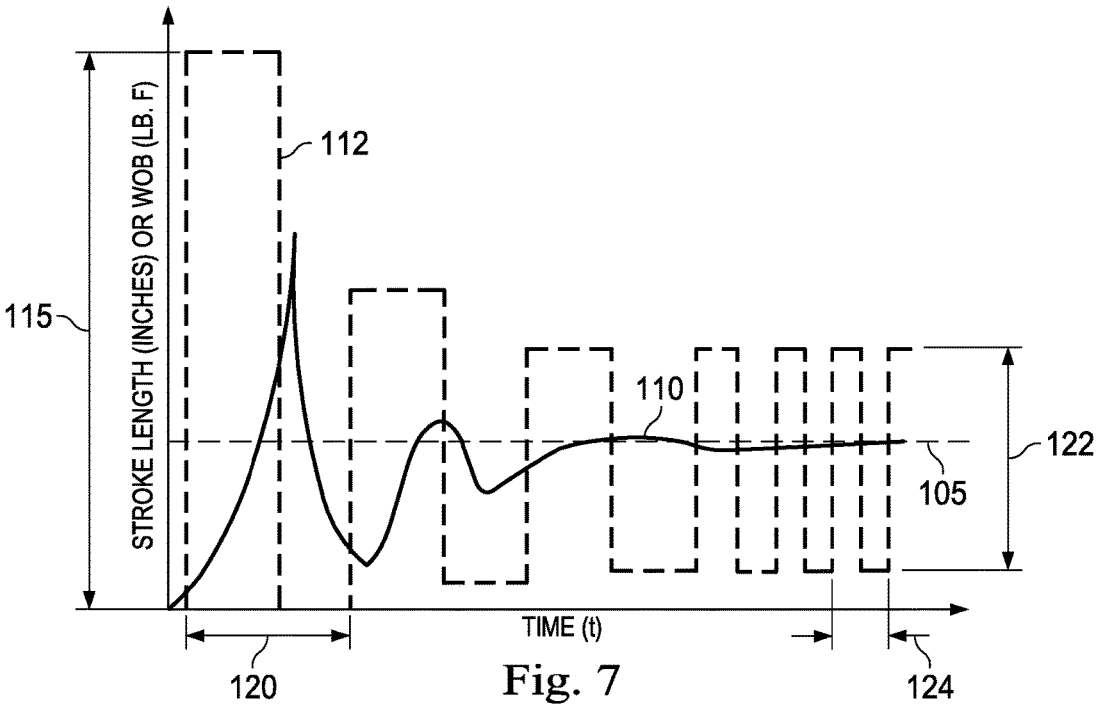
FIG. 7 is a graph showing the effect of the variable valve axial oscillation tool on a weight on bit value, according to some embodiments.

In some embodiments, the tool 30 receives a set point at the step 85. In some embodiments, the PID controller 64 receives the set point, such as a predetermined tool stroke length. In some embodiments, the set point is a predetermined WOB value 105, as illustrated in FIG. 7. In some embodiments, the tool 30 attempts to maintain or achieve a measured WOB 110 at the predetermined WOB value 105. In some embodiments, the tool 30 receives the predetermined WOB value 105 while downhole via the communication device 76 and/or the telemetry system 75. Alternatively, the predetermined WOB value 105 may be received by the tool 30 and stored in the database 74 before the tool 30 is placed downhole.

Figure 8A:
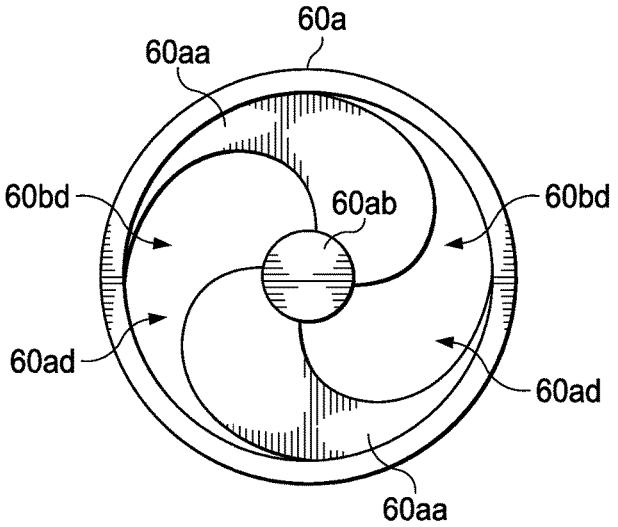
FIGS. 8A, 8B, and 8C are plan views of the valve of FIG. 3 during the execution of steps of the method of FIG. 6, according to some embodiments.
Figure 8B:
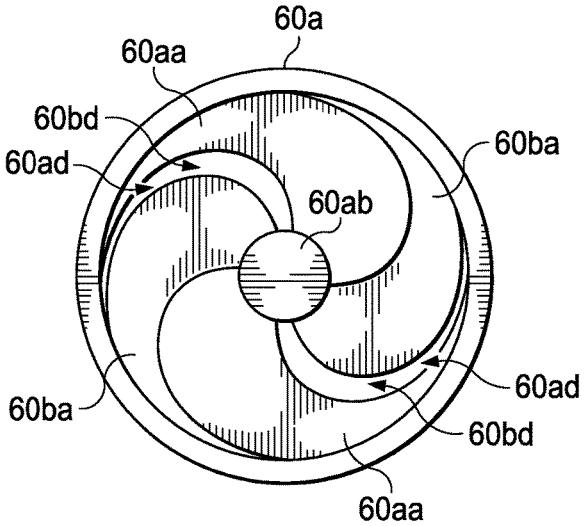
Figure 8C:
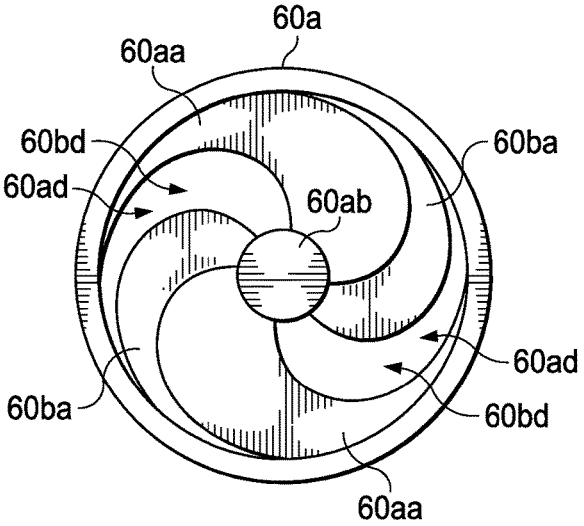

In some embodiments, and after the step 85, the valve 60 is controlled, using the valve operating parameters, at the step 90. In some embodiments, the controller 64, via the servo 62, controls the valve 60 using the valve operating parameters. For example and in some embodiments as illustrated in FIG. 8A, the valve operating parameters include a maximum open position of the valve 60 at zero degrees (0°). That is, the blades 60*ba* of the rotor 60*b* are positioned at a zero degree angle, relative to the blades 60*aa* of the stator 60*a*, so that the blades 60*ba* fully align with the blades 60*aa*. Therefore, the passageways 60*ad* and 60*bd* align to allow the maximum amount of the mud to flow through the valve 60. As illustrated in FIG. 8B, the valve operating parameters also include a maximum closed position of the valve 60 at seventy degrees (70°). That is, the blades 60*ba* are positioned at a seventy degree angle, relative to the blades 60*aa*, so that the blades 60*aa* and 60*ba* do not fully align, or are offset. Therefore, only a small portion of the passageways 60*ad* and 60*bd* align to allow a small amount of mud to flow through the valve 60 if the pump 36 decreases its flow rate. Alternatively, and if the pump 36 does not decrease its flow rate, this partial closing of the valve 60 results in a higher differential pressure drop across the valve 60 while maintaining the same volume of fluid being pumped from the surface. In some embodiments, controlling the valve 60 using the valve operating parameters results in a tool stroke 112 having a tool stroke length 115 and a tool stroke frequency having a tool stroke period 120. That is, the positioning of the valve 60 at the maximum open position at 0° and at the maximum closed position 70° creates a pressure pulse within the mud that is associated with a tool stroke 112 that has a tool stroke length 115. In some embodiments, the valve operating parameters are stored within the database 74 before the tool 30 is placed downhole. In several other embodiments, the valve operating parameters are received from the surface system 41 or another downhole tool via the communication device 76 or the telemetry system 75 while the tool 30 is downhole. Regardless, the controller 64, via the servo 62, controls the valve 60 to create the tool stroke length 115 and the tool stroke frequency having the tool stroke period 120.

In some embodiments and after the step 90, the tool 30 receives feedback data at the step 95. In some embodiments, the feedback data includes the measured WOB 110 received from the surface system 41 via the communication device 76. The communication device 76 communicates the measured WOB 110 to the controller 64. In some embodiments, the feedback data includes one or more of the thrust force, as measured by the strain sensor 70; the pressure amplitude, as detected by the pressure sensor 68 or as inferred by the sensor 67; the tool stroke length as detected by the proximity sensor 58; the annulus pressure as detected by the sensor 77; any other data received from other downhole tools or via the surface system 41; and the tool stroke frequency.

Before, during, or after the step 95, the valve 60 is controlled, using the refined valve operating parameters that are determined in response to the feedback data, at the step 100. In some embodiments, the controller 64 controls the valve 60, via the servo 62, using the refined valve operating parameters. In some embodiments, the controller 64 uses the feedback control system 73 to identify or create the refined valve operating parameters. In some embodiments, the controller 64 compares the measured WOB 110 to the predetermined WOB value 105. In response to any difference between the measured WOB 110 and the predetermined WOB value 105, the controller 64 corrects or refines the valve operating parameters to create refined valve operating parameters. For example, the controller 64 may refine the maximum closed position of the valve 60 so that the maximum closed position of the valve 60 is forty-five degrees (45°). That is, the blades 60*ba* of the rotor 60*b* are positioned at a forty-five degree angle, relative to the blades 60*aa* of the stator 60*a*, so that the blades 60*aa* and 60*ba* do not fully align, or are offset. Therefore, only a portion of the passageways 60*ad* and 60*bd* align to allow an amount of mud to flow through the valve 60, where the amount is greater than the amount associated with the position of the valve 60 at seventy degrees (70°). The controller 64, via the servo 62, controls the valve 60, using the refined valve operating parameters to create a stroke length 122 and a stroke frequency having a stroke period 124. That is, the positioning of the valve 60, using the refined operating valve parameters (i.e., maximum closed position of (70°), creates a pressure pulse within the mud that is associated with a tool stroke 112 that has a tool stroke length 122. As shown in FIG. 7, this creates oscillations that bring the measured WOB 110 closer, or equal, to the predetermined WOB value 105. That is, the tool 30 "self-tunes" the valve operating parameters, using the PID controller 64, to find the tool stroke length 122 and the tool stroke frequency having the tool stroke period 124 that result in the measured WOB 110 reaching or maintaining the predetermined WOB value 105. Specific examples of valve position are given for explanatory purposes only and the maximum closed position of the valve 60 and the maximum open position of the valve 60 can be any range of positions. Additionally, the tool 30 may be configured to stop functioning while the valve 60 is in the fully open position if the tool 30 detects, through the use of any variety of sensors, that the drill bit 26 has been lifted off the bottom of the bore hole 33 or if the tool 30 is commanded to stop by an operator on the surface via the telemetry system 75 or the communication device 76. The tool 30 may begin functioning again once weight on the drill bit is detected or it is commanded to do so by the operator on the surface.

After the step 100, the next step is the step 95 so that the tool 30 can maintain or further refine the refined valve operating parameters to maintain or achieve the set point. In some embodiments, repeating the steps 95 and 100 reduces the difference between the predetermined WOB value 105 and the measured WOB 110. The tool 30 can further correct the refined valve operating parameters to maintain or attempt to reach the predetermined WOB value 105 under changing drilling conditions, as should be understood by those skilled in the art. For example, the tool 30 may determine that a small pressure differential results in adequate oscillation of the drill string 18 to achieve the predetermined WOB value 105 when the BHA 24 is located near the wellhead 22, whereas a large pressure differential results in adequate oscillation of the drill string 18 to achieve the predetermined WOB value 105 when the BHA 24 is located further away from the wellhead 22.

In some embodiments, the method 80 may be used to vary the operation of the variable valve 60 in response to changes in the axial drag force and the axial friction force acting on the drill string 18. That is, the tool 30 varies the valve operating parameters, and therefore the tool stroke frequency and the tool stroke length, in response to feedback data received while downhole to adapt to changing conditions around the drill string 18. The method 80 may be used to change the tool stroke frequency independently of a flow rate of the mud that is pumped from the surface. That is, a mud flow rate, as pumped from the surface of the well, does not limit or determine the tool stroke frequency created by the tool 30 so long as there is the minimum amount of energy available from the mud flow and pump pressure to oscillate the drill string 18 at the desired tool stroke and tool stroke frequency. In some embodiments, the tool 30 operates to oscillate, move, and/or vibrate a portion of the drill string 18, in response to feedback data received while downhole to adapt to changing conditions around the drill string 18. The method 80 may be used to change the oscillation, movement, and/or vibration of a portion of the drill string 18 independently of a flow rate of the mud that is pumped from the surface.

Figure 9:
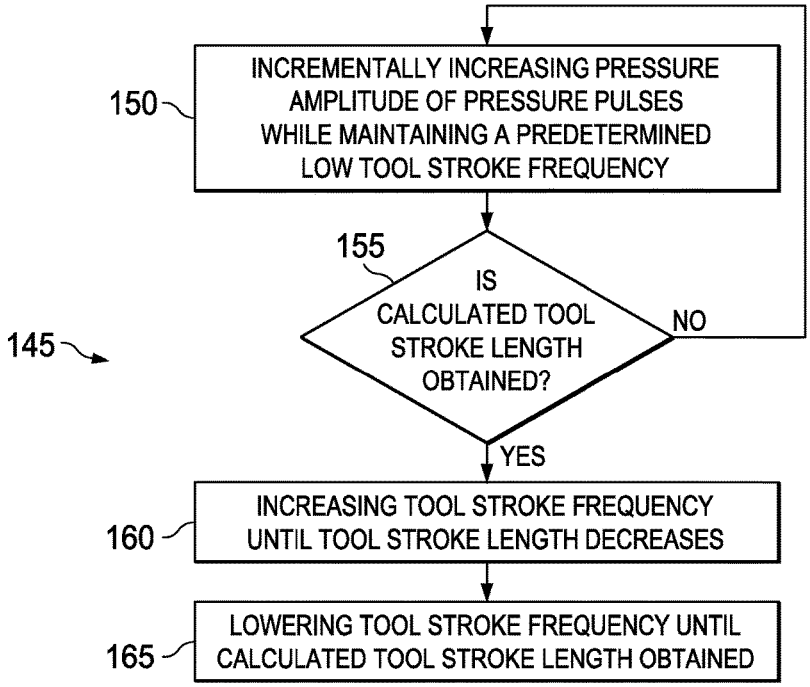
FIG. 9 illustrates another method of operating the variable valve axial oscillation tool of FIG. 1, according to some embodiments.

Exemplary embodiments of the present disclosure can be altered in a variety of ways. In some embodiments, the controller 64 may be a one-degree-of-freedom actuator with the tool stroke length as the one degree of freedom and the set point as the calculated tool stroke length projected to maintain or reach the predetermined WOB value 105. Instead of receiving the measured WOB 110 from the surface system 41, the controller 64 may use the drilling-related data, such as the data relating to the model of the drill string 18, planned trajectories of the BHA 24, and the calculated tool stroke length projected to maintain or reach the predetermined WOB value 105. A method of operating the tool 30 that has one-degree-of-freedom control system is generally referred to by the reference numeral 145 as illustrated in FIG. 9. The method 145 includes incrementally increasing the pressure amplitude of pressure pulses while maintaining a predetermined low tool stroke frequency at step 150, determining whether the calculated tool stroke length is obtained at step 155, increasing the tool stroke frequency until the tool stroke length decreases at step 160, and lowering the tool stroke frequency until the calculated tool stroke length is obtained at step 165. In some embodiments, the frequencies selected for the operation of the tool 30 are adjusted to avoid interfering with the MWD/LWD system 31, the telemetry system 32, or downhole tools elsewhere in the drill string 18. For example, the tool 30 can operate so that the tool 30 has a higher oscillation frequency than the telemetry frequency of the MWD/LWD system 31 and/or the telemetry system 32. The tool 30 can operate so that the stroke frequency remains above a designated threshold frequency in order to accommodate the MWD/LWD system 31 and/or the telemetry system 32.

In some embodiments, the tool 30 controls the valve 60 to incrementally increase the pressure amplitude of the pressure pulses while maintaining a predetermined low tool stroke frequency at the step 150. In some embodiments, the predetermined low tool stroke frequency is, for example, a 3 second cycle time with a 50% duty cycle. The controller 64 controls the valve 60, via the servo 62, to create pressure pulses having a pressure amplitude at a low tool stroke frequency. The controller 64 controls the valve 60, via the servo 62, to incrementally increase the pressure amplitude of the pressure pulses and thereby increase the tool stroke length.

Before, during, or after the step 150, the controller 64 determines if the calculated tool stroke length has been obtained at the step 155. The pressure gauge 68 detects the pressure differential across the valve 60, which corresponds to the pressure amplitude, and communicates the pressure differential to the controller 64. The controller 64 uses the pressure differential to determine a translated tool stroke length, which is used as the feedback for the feedback control system 73 within the controller 64. The controller 64 compares the translated tool stroke length to the calculated tool stroke length to determine whether the calculated tool stroke length has been obtained.

After the step 155 and if the calculated tool stroke length has not been obtained, the next step is the step 150.

After the step 155 and if the calculated tool stroke length has been obtained, the tool 30 increases the tool stroke frequency until the tool stroke length decreases at the step 160. The controller 64 changes the valve operating parameters so that the tool stroke frequency, as determined by the proximity sensor 58 and the controller 64, increases.

After the step 160, the tool 30 lowers the tool stroke frequency until the calculated tool stroke length is obtained at the step 165. The controller 64 changes the valve operating parameters so that the tool stroke frequency decreases. That is, the tool 30 "self-tunes" the valve operating parameters, using the PID controller 64, to obtain the calculated tool stroke length projected to maintain or reach the predetermined WOB value 105. The method 145 may be used to change the tool stroke frequency independently from a flow rate of the mud that is pumped from the surface. That is, a mud flow rate, as pumped from the surface of the well, does not limit or determine the tool stroke frequency created by the tool 30. The method 145 may be used to change the oscillation, movement, and/or vibration of a portion of the drill string 18 independently of a flow rate of the mud that is pumped from the surface.

Figure 10:
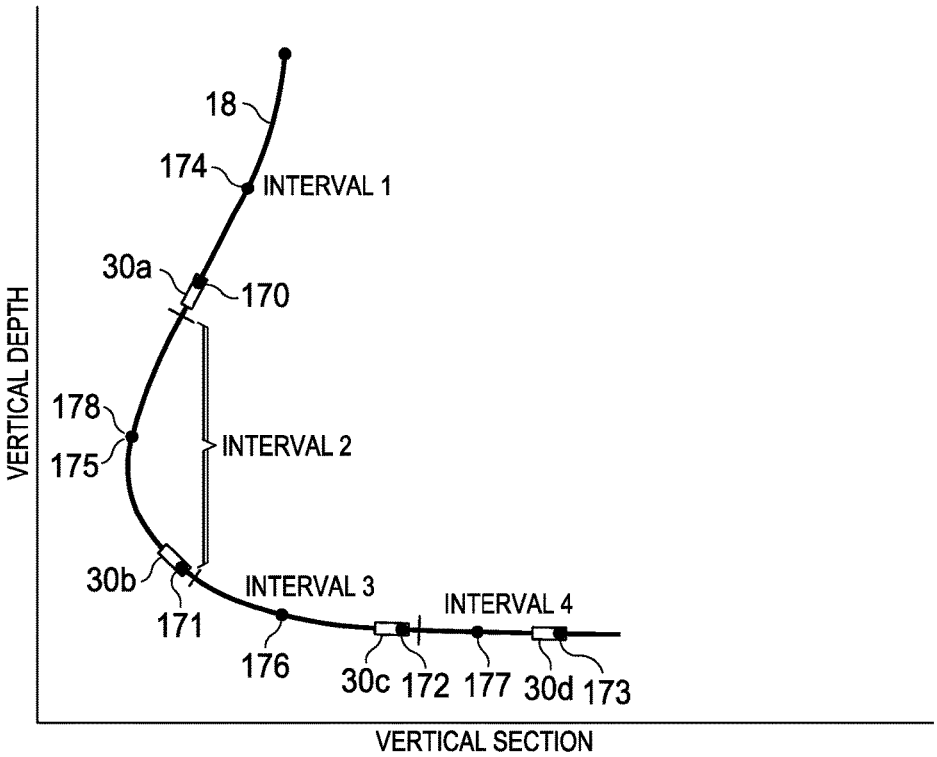
FIG. 10 is a schematic illustration of a drill string including a plurality of variable valve axial oscillation tools along a well path.

In some embodiments and as illustrated in FIG. 10, the drill string 18 includes a tool 30*a* located uphole from a tool 30*b*, which is located uphole from a tool 30*c*, which is located uphole from a tool 30*d*. As the bore hole 33 lengthens, each tool 30*a*, 30*b*, 30*c*, and 30*d* moves relative to an Interval 1, Interval 2, Interval 3, and Interval 4 of the bore hole 33 (not shown). In some embodiments, as the tool 30*b* progresses out of an interval of interest such as, for example the Interval 2, the tool 30*b* transmits a set of optimal valve operating parameters that was a result of the tool 30*b* refining the valve operating parameters while located in the Interval 2, to the tool 30*a* via the communication device 76 of the tool 30*b*. The tool 30*a*, which is progressing into the Interval 2, receives the set of optimal valve operating parameters via the communication device 76 of the tool 30*a*. This transfer of data, or the set of optimal valve operating parameters, between the tools 30*a* and 30*b* prevents any point within the Interval 2 from entering the static dynamic mode. The transfer of the set of optimal valve operating parameters between the tools 30*a* and 30*b* can be transferred via the surface system 41, the telemetry system 75, the wired pipe network, etc. In some embodiments, the surface system 41 monitors transfer of data between downhole tools and allows for the data or instructions transferred between downhole tools, to be ignored or overridden. Therefore, each tool 30*a*, 30*b*, 30*c*, and 30*d* may possess an individual network address accessed over any form of a data network, and each tool 30*a*, 30*b*, 30*c*, and 30*d* may be addressed uniquely; all tools 30*a*, 30*b*, 30*c*, and 30*d* may be addressed globally; or groups of certain tools can be addressed to command or transfer data between various points in the network. In some embodiments, the feedback data for each of the tools 30*a*, 30*b*, 30*c*, and 30*d* may be received from one or more sensors located anywhere along the drill string 18. In some embodiments, each tool 30*a*, 30*b*, 30*c*, and 30*d* includes a sensor 170, 171, 172, and 173, respectively. In some embodiments, sensors 174, 175, 176, and 177 are included along the drill string 18. In some embodiments, each tool 30*a*, 30*b*, 30*d*, and 30*d* can access data from any one or more of the sensors 170-177. For example, the tool 30*a* receives feedback data from the sensor 175 located at point 178 within Interval 2 of the drill string 18 to detect if there is adequate axial movement or vibration of the drill string 18 within Interval 2.

In some embodiments, the valve operating parameters do not include the tool stroke length and instead, the valve parameters include a predetermined valve position. When the valve operating parameters include the predetermined valve position, the tool stroke frequency and the pressure amplitude may be a predetermined tool stroke frequency and a predetermined pressure amplitude, respectively. Data relating to the predetermined tool stroke frequency, the predetermined pressure amplitude, and the predetermined valve position may be stored in the database 74 before the tool 30 is place downhole. However, the communication device 76 can receive data relating to a different predetermined pressure amplitude and a different predetermined frequency from the surface system 41 or from other down hole tools, thereby allowing the tool stroke frequency and the pressure amplitude to change after the tool 30 is placed downhole. Additionally, the predetermined tool stroke frequency and the predetermined pressure amplitude can be refined, using the PID controller 64, to maintain or reach the predetermined WOB value 105.

In some embodiments, the controller 64 controls the valve 60 in an "open loop manner" in which the controller 64 creates the refined valve parameters based on pre-planned values and set points associated with the drilling of the well. These set points can change based on other indicators such as sensed hole inclination or simply time duration, assuming the well is drilled at a certain rate or rates as time progresses. Thus, the variable valve system 46 may control the tool 30 in many other "open loop" ways without directly measuring the effect on the WOB.

In some embodiments, the predetermined WOB value 105 includes a range of WOB values. Therefore, the set point for the PID controller 64 may be a range of WOB values.

In some embodiments, the plurality of tools 30 distributed along the drill string 18 may cooperatively work together such that all, or substantially all, of the intervals of the drill string 18 are stroking in the same direction and at the same frequency at relatively the same time. Alternately, a number of the plurality of the tools 30 may interfere with another number of the plurality of the tools 30 by being out of phase with the another number of the plurality of the tools 30 in the drill string 18 while operating at the same tool frequency. Further, a number of the plurality of the tools 30 may operate in a pseudo random manner. Further, the operation of the plurality of the tools 30 may be coordinated such that a number of the plurality of the tools 30 provide a strong axial force while another number of the plurality of the tools 30 fine tune the response of a local interval by adding or subtracting a local force over a smaller interval. The control of such coordination can be accomplished through the use of a down hole communications network, preferably through the use of one master control located on the surface or located down hole to coordinate the entire drill string 18 response.

In some embodiments, the valve operating parameters and/or the refined valve operating parameters do not form tool strokes that create a uniform wave form. The tool strokes may form any desirable wave pattern that is determined optimal for the set performance settings of the overall system. For example, the duty cycle of the maximum pressure drop across the valve 60 may be 70% of the overall wave period. Further, the wave form may not be periodic in nature, but may contain a plurality of frequencies that are merged together into one wave form to produce a desired effect on the load transfer to the drill bit 26. For example, an impulse or strong spike to the mud pressure could be used to start the agitation or oscillation, and if movement of the lower sleeve 44 relative to the spline sleeve 42 is sensed by the proximity sensor 58, then a more relaxed and smoother cycling can be applied where the valve 60 has a lower derivative value or rate of change of movement between the start and end and return to start position.

In some exemplary embodiments, the valve 60 may operate at a consistent tool stroke frequency while varying the tool stroke length. Alternatively, in other exemplary embodiments, the valve 60 operates to vary the tool stroke frequency while maintaining the tool stroke length.

In some embodiments, the drilling related data can include a predetermined tool stroke length and predetermined tool stroke frequency predicted to agitate or vibrate a portion of the drill string 18 located below the tool 30 that is based on the model of the drill string 18.

In some embodiments, the tool 30 includes an accelerometer to detect axial motion of the tool 30 and/or axial motion at a location along the drill string 18. In some embodiments, the feedback data includes the data received from the accelerometer via the communication device 76.

In some embodiments, data is stored in the database 74 regarding the frequency range of the telemetry pulses associated with other tools located in the drill string 18, such as the motor 28. The controller 64, in response to the data regarding the frequency range of the motor 28, controls the valve 60 using the valve operating parameters to create pressure pulses that are outside of the range of the telemetry pulses associated with the motor 28, thereby preventing or limiting interference of the telemetry pulses associated with the motor 28.

In some embodiments, the sensor 67 is the communication device 76. As described above, the sensor 67 in part determines the RPM of the turbine 66, and the RPM of the turbine 66 depends on the flow rate of the mud. The surface system 41 may vary the flow rate of the mud in accordance with a binary communication system. The sensor 67 detects the variation in the flow rate and the controller 64 decodes the variations, using the binary communication system, to receive data from the surface system 41 or from another mud pulse transmitter located on another down hole tool elsewhere in the drill string 18. Therefore, the surface system 41 or another mud pulse transmitter elsewhere in the drill string 18 may communicate with the tool 30 via the sensor 67. For example, the surface system 41 or the another mud pulse transmitter may provide instructions for the tool 30 to operate only in response to sliding conditions, or when the drill string 18 is not rotating. Additionally, the surface system 41 or the another mud pulse transmitter may provide instructions for the tool 30—while the tool 30 is downhole—to start or stop oscillating a local portion of the drill string 18. For example, the BHA 24 may include a variety of sensors for sensing rotation, such as, for example, survey accelerometers, magnetometers, a rate gyro, that are electrically connected to the MWD/LWD system 31 and/or the telemetry system 32. Therefore, the MWD/LWD system 31 or another BHA controller tool may be used to provide data to and/or to provide instructions to the tool 30 in the drill string 18.

In another exemplary embodiment, the tool 30 also includes a rotation sensor (not shown) in communication with the controller 64 so that the rotation sensor detects rotation of the drill string 18. The controller 64 controls the valve 60, via the servo 62, to maintain the valve 60 in a fully open position when the rotation sensor detects rotation of the drill string 18. Additionally, the controller 64 controls the valve 60, via the servo 62, to alter the valve operating parameters or the refined valve operating parameters when the drill string 18 reaches a rotation threshold, as detected by the rotation sensor. In some embodiments, the rotation threshold is stored in the database 74 before the tool 30 is placed downhole. However, in several other embodiments, the rotation threshold is received from the surface system 41 or the another mud pulse transmitter via the communication device 76 while the tool 30 is downhole.

In some embodiments, the controller 64 controls the valve 60, via the servo 62, to create small pressure amplitudes to prevent or limit damage of electrical equipment on the drill string 18. That is, the tool 30 generally creates small oscillations initially, to prevent creating a strong impact load or pressure wave to other down hole tools while hunting for a set of optimal valve operating parameters.

In some embodiments, the input 73*a* of the feedback control system 73 is a target value such as, for example, the WOB value 105, the predetermined stroke length, a predetermined annular pressure, a TOB value, or on/off instructions received via the sensor 67 or the communication device 76. In some embodiments, the feedback controller 73*c* is the controller 64, the process 73*d* is the operation of the valve 60 via the servo 62, the output is the stroke 112. In some embodiments, the sensor/transmitter 77*g* is the sensor 58, 67, 68, 70, 78, and any other sensor discussed above.

In some embodiments, the servo 62 includes the controller 64 or the controller 64 includes the servo 62. In some embodiments, the servo 62 includes a plurality of controllers. In some embodiments, the controller 64 includes a plurality of controllers. In some embodiments, the feedback data received by the controller 64 is real-time sensed data or slightly delayed sensed data.

In some embodiments, the controller 64, having the feedback control system 73, is coupled to any downhole tool having a valve or system that controls the mud flow through the downhole tool, to form the variable valve axial oscillation tool 30. That is, the tool 30 includes a downhole tool that controls the mud flow through the downhole tool and the feedback control system 73 or other type of open-loop or closed-loop control system. Alternatively, the addition of a by-pass valve that is coupled to the feedback control system 73 to a downhole tool that creates pressure pulses directionally proportional to the mud flow rate can result in the downhool tool that operates similarly to the tool 30.

In one aspect, the present disclosure is directed to an apparatus for creating localized axial movement of a drill string that is located downhole. The apparatus includes a lower sleeve coupled to the drill string and defining a passage to accommodate a fluid flowing through the drill string; an upper sleeve coupled to the drill string and concentrically disposed about the lower sleeve; a variable valve within the passage; and a controller operatively connected to the variable valve for controlling the flow of the fluid flowing through the lower sleeve to cause the lower sleeve to move relative to the upper sleeve to create localized axial movement of the drill string. In an exemplary embodiment, the controller is a proportional-integral-derivative controller. In an exemplary embodiment, the lower sleeve moves relative to the upper sleeve by a stroke length to create a stroke frequency; the stroke length is a degree of freedom for the proportional-integral-derivative controller; and the stroke frequency is another degree of freedom for the proportional-integral-derivative controller. In an exemplary embodiment, the apparatus also includes a communication device operatively connected to the controller for receiving feedback data relating to a downhole condition that is affected by the flow of the fluid through the lower sleeve; and wherein the controller, in response to the receipt of the feedback data, changes the flow of the fluid through the lower sleeve to affect the downhole condition. In an exemplary embodiment, the apparatus also includes a sensor that is operatively connected to the controller for monitoring a downhole condition that is affected by the flow of the fluid through the lower sleeve; and wherein the controller, in response to the monitored downhole condition, changes the flow of the fluid flowing through the lower sleeve to affect the downhole condition. In an exemplary embodiment, the apparatus also includes a proximity sensor that is located on the lower sleeve and is operatively connected to the controller and that detects movement of the lower sleeve relative to the upper sleeve. In an exemplary embodiment, the downhole condition is an amount of force exerted upon the drill string and the feedback data is received from a surface system or a tool located downhole.

In another aspect, the present disclosure is directed to a method for creating localized axial movement of a drill string. The method includes coupling a tool to the drill string, the tool including: a lower sleeve coupled to the drill string and defining a passage to accommodate a fluid flowing through the drill string; an upper sleeve coupled to the drill string and concentrically disposed about the lower sleeve; a variable valve within the passage that is positionable between a selected closed position and a selected open position, wherein the selected closed position creates a selected pressure differential across the variable valve and in the fluid flowing through the lower sleeve to cause the lower sleeve to move relative to the upper sleeve to create localized axial movement of the drill string; and a controller operatively connected to the variable valve for controlling the variable valve; and creating a first selected fluid pressure differential across the variable valve, using the controller and the variable valve, to move the lower sleeve relative to the upper sleeve to create a first localized axial movement of the drill string. In yet another exemplary embodiment, the controller is a proportional-integral-derivative controller. In yet another exemplary embodiment, the selected pressure differential across the variable valve causes the lower sleeve to move relative to the upper sleeve by a stroke length to create a stroke frequency; wherein the stroke length is a degree of freedom for the proportional-integral-derivative controller; and wherein the stroke frequency is another degree of freedom for the proportional-integral-derivative controller. In some exemplary embodiments, the method also includes receiving feedback data relating to a downhole condition that is a function of the first selected pressure differential across the variable valve using a communication device that is operatively connected to the controller; and creating a second selected fluid pressure differential across the variable valve, in response to the receipt of the feedback data, to move the lower sleeve relative to the upper sleeve to create a second localized axial movement of the drill string. In some exemplary embodiments, the method also includes monitoring a downhole condition that is a function of the first selected pressure differential across the variable valve using a sensor operatively connected to the controller; and creating a second selected fluid pressure differential across the variable valve, in response to the receipt of the feedback data, to move the lower sleeve relative to the upper sleeve to create a second localized axial movement of the drill string. In some exemplary embodiments, the first selected pressure differential across the variable valve causes the lower sleeve to move relative to the upper sleeve by a first stroke length; and the method also includes measuring the first stroke length using a proximity sensor that is operatively connected to the controller; and creating, in response to the measured first stroke length, a second selected fluid pressure differential across the variable valve, using the controller and the variable valve, to cause the lower sleeve to move relative to the upper sleeve by a second stroke length.

Another aspect of the present disclosure is directed to a tool for oscillating a portion of a drill string that is located downhole. The tool includes a lower sleeve coupled to the drill string and defining a passage to accommodate a fluid flowing through the drill string; an upper sleeve coupled to the drill string and concentrically disposed about the lower sleeve; a variable valve within the passage that is positionable between a selected open position and a selected closed position, wherein the selected closed position creates a selected pressure differential across the variable valve and in the fluid flowing through the lower sleeve to cause the lower sleeve to move relative to the upper sleeve by a stroke length at a stroke frequency thereby oscillating the portion of the drill string; and a controller operatively connected to the variable valve for identifying a first selected open position and a first selected closed position of the variable valve and for storing a predetermined value of a downhole condition that is a function of at least one of the selected open position and the selected closed position. In an exemplary embodiment, the controller is a proportional-integral-derivative controller and the predetermined value of the downhole condition is a setpoint of the proportional-integral-derivative controller. In an exemplary embodiment, the stroke length is a degree of freedom for the proportional-integral-derivative controller; and the stroke frequency is another degree of freedom for the proportional-integral-derivative controller. In an exemplary embodiment, the controller receives a measured value of the downhole condition, calculates the difference between the measured value and the predetermined value, and, in response to the difference, identifies a second selected open position of the variable valve and a second selected closed position of the variable valve. In an exemplary embodiment, the tool also includes a sensor operatively connected to the controller for measuring the value of the downhole condition. In an exemplary embodiment, a communication device operatively connected to the controller for receiving the measured value of the downhole condition from a surface system or another tool that is located downhole. In an exemplary embodiment, the downhole condition is a force exerted upon the portion of the drill string.

Moreover, any of the methods described herein may be embodied within a system including electronic processing circuitry to implement any of the methods, or a in a computer-program product including instructions which, when executed by at least one processor, causes the processor to perform any of the methods described herein.

In some embodiments, while different steps, processes, and procedures are described as appearing as distinct acts, one or more of the steps, one or more of the processes, and/or one or more of the procedures could also be performed in different orders, simultaneously and/or sequentially. In some embodiments, the steps, processes and/or procedures could be merged into one or more steps, processes and/or procedures.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. An apparatus for oscillating a portion of a string of tubulars that is located downhole, the apparatus comprising:

a lower sleeve coupled to the string of tubulars and defining a passage to accommodate a drilling fluid flowing through the string of tubulars;

an upper sleeve coupled to the string of tubulars and concentrically disposed about the lower sleeve;

wherein a portion of the lower sleeve is axially positioned between a first shoulder face formed in the upper sleeve and a second opposing shoulder face formed in the upper sleeve; and wherein the lower sleeve is movable, relative to the upper sleeve, between the first and second shoulder faces;

a first spring positioned between a portion of the lower sleeve and the first shoulder face;

a second spring positioned between the portion of the lower sleeve and the second shoulder face;

a variable valve within the passage of the lower sleeve that is positionable between a selected open position and a selected closed position, wherein the selected closed position creates a selected pressure differential across the variable valve and in the drilling fluid flowing through the lower sleeve to cause the lower sleeve to move relative to the upper sleeve by a stroke length at a stroke frequency thereby oscillating the portion of the string of tubulars; and a controller operatively connected to the variable valve for controlling the position of the variable valve;

wherein the stroke length is based on the position on the variable valve, a distance between the first and second shoulder faces, and a maximum spring compression of each of the first and second springs.

2. The apparatus of claim 1, wherein the controller is a proportional-integral-derivative controller;

wherein the stroke length is a degree of freedom for the proportional-integral-derivative controller; and wherein the stroke frequency is another degree of freedom for the proportional-integral-derivative controller.

3. The apparatus of claim 1, further comprising a communication device operatively connected to the controller for receiving feedback data relating to a downhole condition that is affected by the flow of the fluid through the lower sleeve; and wherein the controller, in response to the receipt of the feedback data, changes the position of the variable valve to change the flow of the fluid through the lower sleeve to affect the downhole condition.

4. The apparatus of claim 3, wherein the downhole condition is an amount of force exerted upon the string of tubulars and the feedback data is received from a surface system or a tool located downhole.

5. The apparatus of claim 1, further comprising a sensor that is operatively connected to the controller for monitoring a downhole condition that is affected by the flow of the fluid through the lower sleeve; and wherein the controller, in response to the monitored downhole condition, changes the position of the variable valve to change the flow of the fluid flowing through the lower sleeve to affect the downhole condition.

6. The apparatus of claim 1, further comprising a proximity sensor that is located on the lower sleeve and is operatively connected to the controller and that detects movement of the lower sleeve relative to the upper sleeve.

7. A method for creating localized axial movement of a string of tubulars, the method comprising:

coupling a tool to the string of tubulars, the tool comprising:

a lower sleeve coupled to the string of tubulars and defining a passage to accommodate a drilling fluid flowing through the string of tubulars;

an upper sleeve coupled to the string of tubulars and concentrically disposed about the lower sleeve;

wherein a portion of the lower sleeve is axially positioned between a first shoulder face formed in the upper sleeve and a second opposing shoulder face formed in the upper sleeve; and wherein the lower sleeve is movable relative to the upper sleeve by a maximum stroke length defined by an axial distance between the first and second shoulder faces;

a variable valve within the passage of the lower sleeve, wherein the variable valve is positionable between a selected closed position and a selected open position, wherein the selected closed position creates a selected pressure differential across the variable valve and in the drilling fluid flowing through the lower sleeve to cause the lower sleeve to move relative to the upper sleeve to create localized axial movement of the string of tubulars; and a controller operatively connected to the variable valve for controlling the variable valve; and repeatedly creating a first selected fluid pressure differential across the variable valve, using the controller and the variable valve, to repeatedly move the lower sleeve relative to the upper sleeve by a first stroke length that is less than the maximum stroke length to create a first localized axial movement of the string of tubulars.

8. The method of claim 7, wherein the controller is a proportional-integral-derivative controller.

9. The method of claim 8, wherein the repeated creation of the first selected pressure differential across the variable valve causes the lower sleeve to move relative to the upper sleeve by the first stroke length at a stroke frequency;

wherein the first stroke length is a degree of freedom for the proportional-integral-derivative controller; and wherein the stroke frequency is another degree of freedom for the proportional-integral-derivative controller.

10. The method of claim 7, further comprising:

receiving feedback data relating to a downhole condition that is a function of the first selected pressure differential across the variable valve using a communication device that is operatively connected to the controller; and repeatedly creating a second selected fluid pressure differential across the variable valve, in response to the receipt of the feedback data, to repeatedly move the lower sleeve relative to the upper sleeve to create a second localized axial movement of the string of tubulars.

11. The method of claim 7, further comprising:

monitoring a downhole condition that is a function of the first selected pressure differential across the variable valve using a sensor operatively connected to the controller; and repeatedly creating a second selected fluid pressure differential across the variable valve, in response to the receipt of the feedback data, to repeatedly move the lower sleeve relative to the upper sleeve to create a second localized axial movement of the string of tubulars.

12. The method of claim 7, further comprising:

measuring the first stroke length using a proximity sensor that is operatively connected to the controller; and creating, in response to the measured first stroke length, a second selected fluid pressure differential across the variable valve, using the controller and the variable valve, to cause the lower sleeve to move relative to the upper sleeve by a second stroke length.

13. A tool for oscillating a portion of a string of tubulars that is located downhole comprising:

a lower sleeve coupled to the string of tubulars and defining a passage to accommodate a drilling fluid flowing through the string of tubulars;

an upper sleeve coupled to the string of tubulars and concentrically disposed about the lower sleeve;

a variable valve within the passage that is positionable between a selected open position and a selected closed position, wherein the selected closed position creates a selected pressure differential across the variable valve and in the drilling fluid flowing through the lower sleeve to cause the lower sleeve to move relative to the upper sleeve by a stroke length at a stroke frequency thereby oscillating the portion of the string of tubulars; and a controller operatively connected to the variable valve for identifying a first selected open position and a first selected closed position of the variable valve and for storing a predetermined value of a downhole condition that is a function of at least one of the selected open position and the selected closed position.

14. The tool of claim 13, wherein the controller is a proportional-integral-derivative controller and the predetermined value of the downhole condition is a setpoint of the proportional-integral-derivative controller.

15. The tool of claim 14, wherein the stroke length is a degree of freedom for the proportional-integral-derivative controller; and wherein the stroke frequency is another degree of freedom for the proportional-integral-derivative controller.

16. The tool of claim 13, wherein the controller receives a measured value of the downhole condition, calculates the difference between the measured value and the predetermined value, and, in response to the difference, identifies a second selected open position of the variable valve and a second selected closed position of the variable valve.

17. The tool of claim 16, further comprising a sensor operatively connected to the controller for measuring the value of the downhole condition.

18. The tool of claim 16, further comprising a communication device operatively connected to the controller for receiving the measured value of the downhole condition from a surface system or another tool that is located downhole.

19. The tool of claim 13, wherein the downhole condition is a force exerted upon the portion of the string of tubulars.

* * * * *